US008335463B2

(12) United States Patent
Fujimori

(10) Patent No.: US 8,335,463 B2
(45) Date of Patent: Dec. 18, 2012

(54) CLEANING DEVICE, PROCESS CARTRIDGE, AND IMAGE FORMING APPARATUS

(75) Inventor: Akira Fujimori, Fujisawa (JP)

(73) Assignee: Ricoh Company, Ltd., Tokyo (JP)

( * ) Notice: Subject to any disclaimer, the term of this patent is extended or adjusted under 35 U.S.C. 154(b) by 365 days.

(21) Appl. No.: 12/659,055

(22) Filed: Feb. 24, 2010

(65) Prior Publication Data

US 2010/0215417 A1 Aug. 26, 2010

(30) Foreign Application Priority Data

Feb. 25, 2009 (JP) ..... 2009-042440

(51) Int. Cl.
*G03G 21/00* (2006.01)

(52) U.S. Cl. ..... 399/350; 399/349; 399/346

(58) Field of Classification Search ..... 399/349, 399/350, 346
See application file for complete search history.

(56) References Cited

U.S. PATENT DOCUMENTS

| | | | | |
|---|---|---|---|---|
| 5,081,504 | A * | 1/1992 | Morisawa et al. | 399/350 |
| 7,302,205 | B2 | 11/2007 | Shintani et al. | |
| 7,313,347 | B2 | 12/2007 | Shintani et al. | |
| 7,885,595 | B2 * | 2/2011 | Ninomiya et al. | 399/346 |
| 8,103,207 | B2 * | 1/2012 | Karasawa et al. | 399/346 |
| 2005/0152722 | A1 * | 7/2005 | Tawada et al. | 399/346 |
| 2005/0169663 | A1 | 8/2005 | Shintani et al. | |
| 2006/0039726 | A1 | 2/2006 | Shinatni et al. | |
| 2008/0170897 | A1 * | 7/2008 | Harada | 399/346 |
| 2008/0181689 | A1 | 7/2008 | Fujimori | |
| 2009/0010687 | A1 * | 1/2009 | Yamada et al. | |
| 2009/0010692 | A1 * | 1/2009 | Hozumi et al. | 399/346 |
| 2009/0060600 | A1 | 3/2009 | Ninomiya et al. | |
| 2010/0034570 | A1 * | 2/2010 | Hatakeyama et al. | 399/346 |
| 2010/0054830 | A1 * | 3/2010 | Thayer et al. | 399/350 |

FOREIGN PATENT DOCUMENTS

| | | | |
|---|---|---|---|
| JP | 2000-330443 | | 11/2000 |
| JP | 2005-070276 | | 3/2005 |
| JP | 2005242025 | A * | 9/2005 |
| JP | 2005-352310 | | 12/2005 |

* cited by examiner

*Primary Examiner* — Susan Lee
(74) *Attorney, Agent, or Firm* — Harness, Dickey & Pierce, P.L.C.

(57) ABSTRACT

A cleaning device including a first blade contacting a surface of an image carrier and a second blade separate from the first blade to contact the surface of the image carrier at a position downstream from the first blade in a direction of rotation of the image carrier relative to a transfer position on the surface of the image carrier. A leading end of the second blade facing up is positioned upstream from a trailing end of the second blade relative to the direction of rotation of the image carrier. A first edge of the leading end of the second blade contacts the surface of the image carrier at a point on the surface of the image carrier below a second edge of the leading end of the second blade.

19 Claims, 4 Drawing Sheets

$$SF\text{-}1 = \frac{(MXLNG)^2}{AREA} \times \frac{\pi}{4} \times 100$$

$$SF\text{-}2 = \frac{(PERI)^2}{AREA} \times \frac{\pi}{4} \times 100$$

CLEANING DEVICE, PROCESS CARTRIDGE, AND IMAGE FORMING APPARATUS

PRIORITY STATEMENT

The present patent application claims priority from Japanese Patent Application No. 2009-042440, filed on Feb. 25, 2009 in the Japan Patent Office, which is hereby incorporated herein by reference in its entirety.

BACKGROUND

1. Technical Field

Illustrative embodiments described in this patent specification generally relate to a cleaning device included in an image forming apparatus employing an electrophotographic method, a process cartridge, and the image forming apparatus.

2. Description of the Related Art

Related-art image forming apparatuses, such as copiers, printers, facsimile machines, or multifunction devices having two or more of copying, printing, and facsimile functions, typically form a toner image on a recording medium (e.g., a sheet of paper, etc.) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus.

The photoconductor rotatable to carry the toner image thereon is generally provided with a cleaning device to clean the surface of the photoconductor. The cleaning device includes, for example, a first blade contacting the surface of the photoconductor and a second blade contacting the surface of the photoconductor at a position downstream from the first blade relative to a direction of rotation of the photoconductor with respect to, as a reference point, a primary transfer position on the surface of the photoconductor. The primary transfer position is where the toner image formed on the surface of the photoconductor is transferred onto a transfer body of the transfer device.

The first and second blades are often provided such that a leading end thereof is positioned upstream from a trailing end thereof relative to the direction of rotation of the photoconductor to efficiently remove residual toner and lubricant adhering to the surface of the photoconductor. In other words, the blades are often provided to contact the surface of the photoconductor against the direction of rotation of the photoconductor.

Regarding the second blade, for example, in addition to the leading end thereof facing up, a first edge of the leading end is caused to contact the surface of the photoconductor at a position higher than a second edge of the leading end of the second blade. By contrast, a second blade in which a leading end thereof is caused to face down is disclosed in Published Unexamined Japanese Patent Application No. 2005-352310 (hereinafter referred to as JP-2005-352310-A).

In another approach, Published Unexamined Japanese Patent Application No. 2000-330443 (hereinafter referred to as JP-2000-330443-A) discloses a cleaning device including a first blade and a second blade in which a leading end of the second blade is caused to face up, and a first edge of the leading end of the second blade is caused to contact a surface of a photoconductor at a position lower than a second edge of the leading end thereof. A lubricant such as zinc stearate fills a space formed by the surface of the photoconductor and the first and second blades, and the second blade is used exclusively to level the lubricant supplied to the surface of the photoconductor.

The residual toner and the lubricant adhering to the surface of the photoconductor can be efficiently removed by the above-described blades contacting the surface of the photoconductor against the direction of rotation of the photoconductor. However, an extreme decrease in the amount of the residual toner and the lubricant entering the space between the surface of the photoconductor and the edges of the blades contacting the surface of the photoconductor can cause problems such as chipping and curling of the blades, noise, and abnormal friction.

Because the residual toner adhering to the surface of the photoconductor immediately after transfer of the toner image onto the transfer member constantly enters the space between the surface of the photoconductor and the edge of the first blade, the above-described problems do not occur at the first blade. By contrast, however, the above-described problems may occur at the second blade because most of the residual toner adhering to the surface of the photoconductor is scraped off by the first blade.

In the first two examples of the second blades described above, because the first edge of the leading end thereof contacting the surface of the photoconductor is positioned above the second edge of the leading end thereof, or the leading end thereof faces down, the residual toner and the lubricant constantly fall from the edge of the second blade, possibly increasing occurrences of the above-described problems.

In a case in which the first blade, the lubricant or a lubricant applicator, and the second blade are provided, in that order, downstream from the primary transfer position on the surface of the photoconductor (that is, downstream relative to the direction of rotation of the photoconductor), the second blade is used to level the lubricant applied to the surface of the photoconductor. However, in the cleaning devices of the related art, because the second blade levels the lubricant supplied to the surface of the photoconductor in the same direction as a direction of fall of the lubricant scraped off thereby, when the lubricant is not evenly supplied to the surface of the photoconductor to begin with the second blade may not function to reliably level the lubricant on the surface of the photoconductor.

As described above, with the second blade disclosed in JP-2000-330443-A, the first edge of the leading end thereof is caused to contact the surface of the photoconductor at a position lower than the second edge of the leading end thereof. In addition, the lubricant is provided within a space defined by the first and second blades and the surface of the photoconductor. Consequently, although the two blades are provided as described above, actually, only the first blade serves as a blade for scraping off the residual toner adhering to the surface of the photoconductor. In other words, the residual toner adhering to the surface of the photoconductor is not effectively scraped off at two positions. An additional problem is that, because it closely contacts the lubricant, the second blade might not be sufficiently elastically deformed, possibly causing uneven leveling of the lubricant on the surface of the photoconductor as a result.

SUMMARY

In view of the foregoing, illustrative embodiments described herein provide a cleaning device capable of preventing the above-described problems, a process cartridge, and an image forming apparatus including the cleaning device.

At least one embodiment provides a cleaning device including a first blade contacting a surface of an image carrier rotatable to carry a toner image to be transferred onto a transfer body, and a second blade separate from the first blade to contact the surface of the image carrier at a position downstream from the first blade in a direction of rotation of the image carrier relative to a transfer position on the surface of the image carrier where the toner image is transferred onto the transfer body. A leading end of the second blade facing up is positioned upstream from a trailing end of the second blade relative to the direction of rotation of the image carrier. A first edge of the leading end of the second blade contacts the surface of the image carrier at a point on the surface of the image carrier below a second edge of the leading end of the second blade.

At least one embodiment provides a process cartridge detachably attachable to an image forming apparatus. The process cartridge includes an image carrier rotatable to carry a toner image to be transferred onto a transfer body, one of a charger to charge a surface of the image carrier and a developing device to develop an electrostatic latent image formed on the surface of the image carrier with toner, and the cleaning device described above.

At least one embodiment provides an image forming apparatus including the process cartridge described above.

Additional features and advantages of the illustrative embodiments will be more fully apparent from the following detailed description, the accompanying drawings, and the associated claims.

BRIEF DESCRIPTION OF THE DRAWINGS

A more complete appreciation of the illustrative embodiments described herein and the many attendant advantages thereof will be readily obtained as the same becomes better understood by reference to the following detailed description when considered in connection with the accompanying drawings, wherein.

Figure 1:
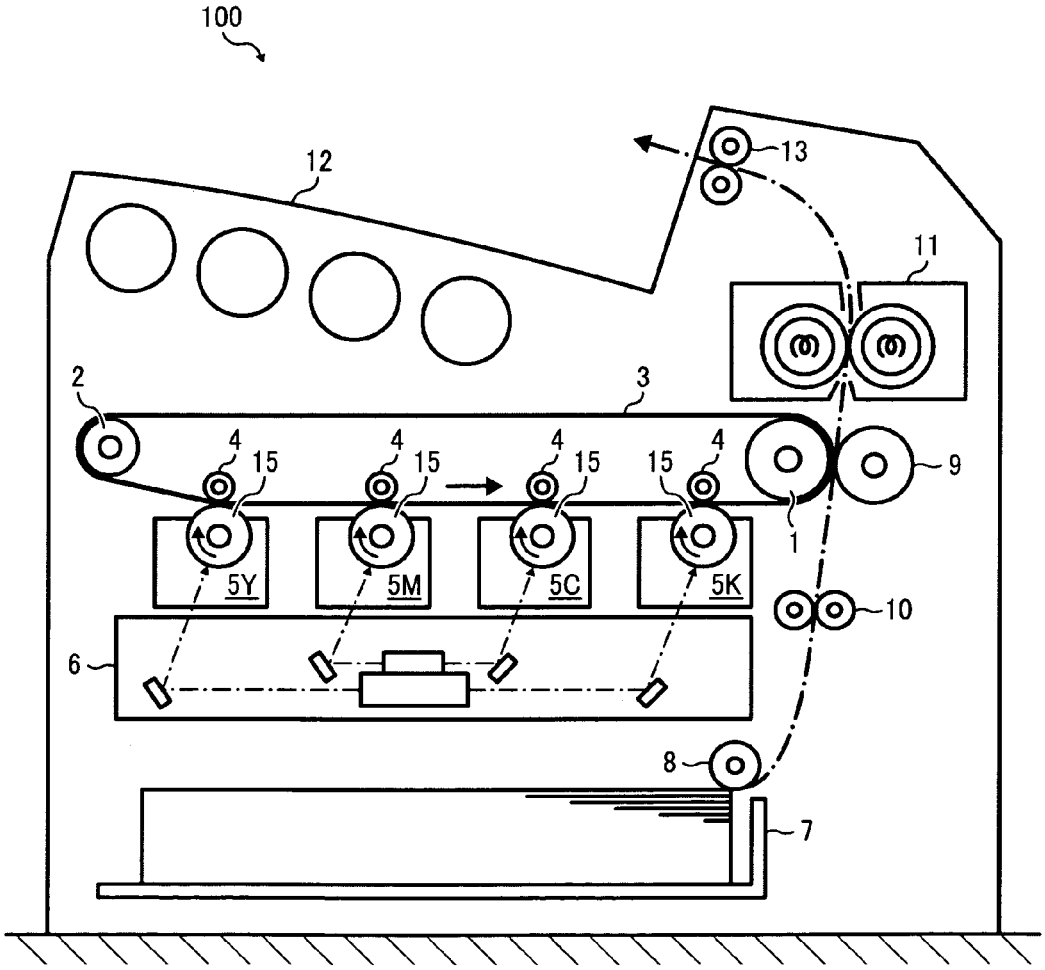
FIG. 1 is a vertical cross-sectional view illustrating a configuration of an image forming apparatus according to illustrative embodiments.

The accompanying drawings are intended to depict illustrative embodiments and should not be interpreted to limit the scope thereof. The accompanying drawings are not to be considered as drawn to scale unless explicitly noted.

DETAILED DESCRIPTION OF ILLUSTRATIVE EMBODIMENTS

In describing illustrative embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

Reference is now made to the drawings, wherein like reference numerals designate identical or corresponding parts throughout the several views.

A description is now given of a configuration of an image forming apparatus including a cleaning device according to illustrative embodiments with reference to FIG. 1.

An image forming apparatus 100 according to illustrative embodiments includes a seamless intermediate transfer belt 3 wound around a driving roller 1 and a driven roller 2 and rotatable in a counterclockwise direction in FIG. 1; primary transfer rollers 4, each provided along an inner bottom surface of the intermediate transfer belt 3 at predetermined intervals; process cartridges 5Y, 5M, 5C, and 5K (hereinafter collectively referred to as process cartridges 5) provided opposite the primary transfer rollers 4, respectively, with the intermediate transfer belt 3 interposed therebetween; an irradiating device 6 provided below the process cartridges 5; a sheet feed tray 7 provided below the irradiating device 6; a sheet feed roller 8 provided near the sheet feed tray 7; a secondary transfer roller 9 provided opposite the driving roller 1 with the intermediate transfer belt 3 therebetween; a pair of registration rollers 10 provided between the secondary transfer roller 9 and the sheet feed roller 8; a fixing device 11 provided above the driving roller 1 and the secondary transfer roller 9; a discharge tray 12 provided on a top surface of the image forming apparatus 100; and a pair of discharge rollers 13 that discharges a sheet having a toner image fixed by the fixing device 11 thereon to the discharge tray 12.

Figure 2:
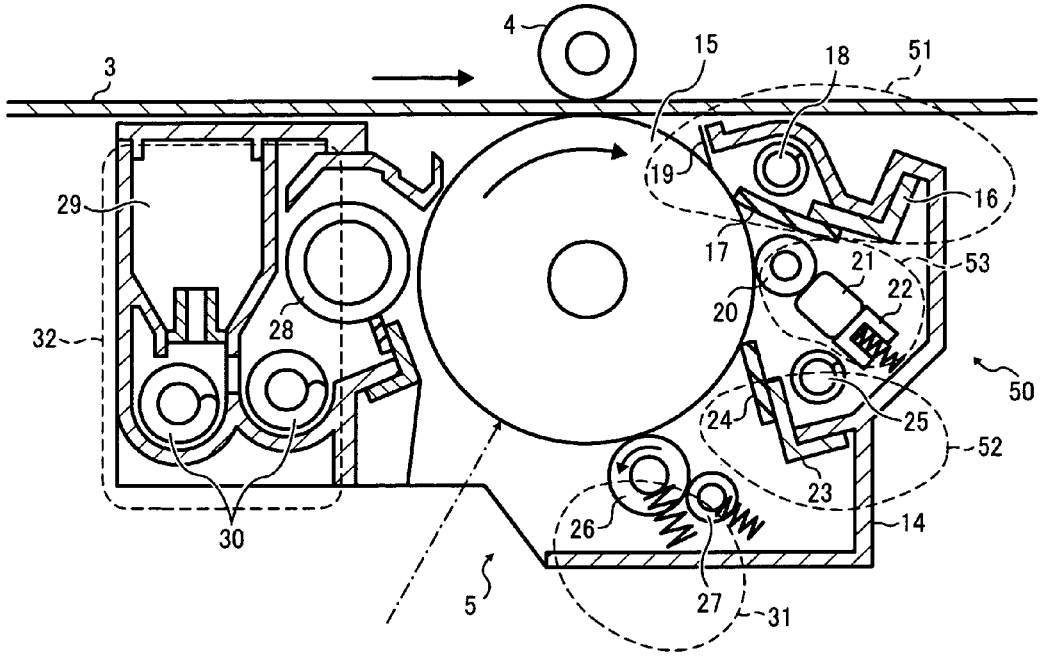
FIG. 2 is a vertical cross-sectional view illustrating a configuration of a process cartridge included in the image forming apparatus illustrated in FIG. 1.

FIG. 2 is a vertical cross-sectional view illustrating a configuration of the process cartridges 5 shown in FIG. 1. Each of the process cartridges 5 includes a cartridge case 14 and a photoconductive drum 15 disposed substantially within the cartridge case 14 and serving as an image carrier rotatable in a clockwise direction in FIG. 2. Each of the process cartridges 5 further includes a cleaning device 50, a charger 31, and a developing device 32, disposed clockwise, in that order, from a primary transfer position at a top center position on a surface of the photoconductive drum 15.

As illustrated in FIG. 1, the four process cartridges 5, each for a specific color, that is, yellow, magenta, cyan, or black, are provided in the image forming apparatus 100 such that the top center position on the surface of the photoconductive drum 15, that is, the primary transfer position, is opposite the primary transfer roller 4 with the intermediate transfer belt 3 interposed therebetween. The process cartridges 5 are detachably attachable to the image forming apparatus 100.

Figure 3:
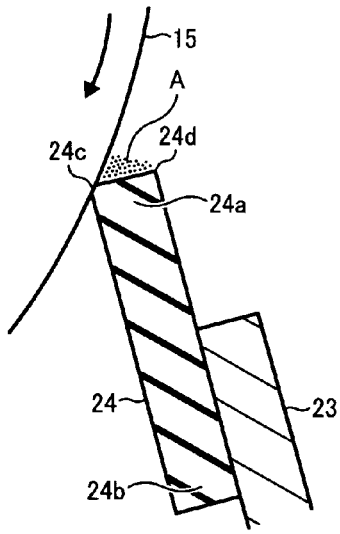
FIG. 3 is an enlarged view illustrating a configuration around a second blade of a cleaning device according to an embodiment of the present invention.

A description is now given of the cleaning device 50 according to illustrative embodiments with reference to FIGS. 2 and 3. FIG. 3 is an enlarged view illustrating a configuration around a second blade 24 included in the cleaning device 50.

The main parts of the cleaning device 50 include a first cleaning unit 51, a lubricant applicator 53, and a second cleaning unit 52. Each of these is described in detail below.

The first cleaning unit 51 includes a first blade holder 16 having an L-shaped vertical cross-section provided at an upper portion of the cartridge case 14; a planar first blade 17, a trailing end of which is fixed to the first blade holder 16, with a leading end of the first blade 17 positioned upstream from the trailing end relative to a direction of rotation of the photoconductive drum 15 and one edge of the leading end (hereinafter referred to as the lower edge) contacts the surface of the photoconductive drum 15; a first conveyance screw 18 rotatably provided within a space formed by the first blade 17 and the cartridge case 14 to convey residual toner and a lubricant scraped off by the first blade 17 to a storage unit, not shown; and a protective sheet 19 that covers a corner of an opening provided on an upper surface of the cartridge case 14, from which an upper portion of the photoconductive drum 15 is exposed, to prevent the residual toner and the lubricant scrapped off by the first blade 17 from scattering.

The lubricant applicator 53 includes a brush roller 20 serving as a lubricant application means rotated in a clockwise direction in FIG. 2 by a driving means, not shown, and provided to contact the surface of the photoconductive drum 15; a lubricant 21 comprising a metallic soap such as zinc stearate to increase transfer efficiency by facilitating removal of the toner image from the surface of the photoconductive drum 15; and a lubricant supporter 22 that supports and presses the lubricant 21 against the brush roller 20 to supply the lubricant 21 to the brush roller 20. The lubricant applicator 53 is provided below the first cleaning unit 51. The brush roller 20 with the lubricant 21 thereon rotatively contacts the surface of the photoconductive drum 15 after the surface of the photoconductive drum 15 is cleaned by the first cleaning unit 51 to supply the lubricant 21 to the surface of the photoconductive drum 15.

The second cleaning unit 52 includes a second blade holder 23 having an L-shaped vertical cross-section provided at a right intermediate portion of the cartridge case 14 below the lubricant applicator 53; a planar second blade 24, a trailing end 24*b* of which is fixed to the second blade holder 23 such that a leading end 24*a* of the second blade 24 is positioned upstream from the trailing end 24*b* relative to the direction of rotation of the photoconductive drum 15, the leading end 24*a* faces up, and a first edge 24*c* of the leading end 24*a* contacts the surface of the photoconductive drum 15 at a position lower than a second edge 24*d* of the leading end 24*a*; and a second conveyance screw 25 rotatably provided within a space formed by the second blade 24, the cartridge case 14, and the lubricant applicator 53 to convey residual toner and a lubricant scraped off by the second blade 24 to a storage unit, not shown.

As described above, both the first and second blades 17 and 24 are provided such that the leading end thereof is positioned upstream from the trailing end thereof relative to the direction of rotation of the photoconductive drum 15. In other words, the first and second blades 17 and 24 contact the surface of the photoconductive drum 15 against the direction of rotation of the photoconductive drum 15.

The second blade 24 is separated a predetermined distance from the first blade 17, and the brush roller 20 is separated from the second blade 24 between the first and second blades 17 and 24. Further, as illustrated in FIG. 3, the second blade 24 is provided such that the leading end 24*a* thereof faces up and the first edge 24*c* of the leading end 24*a* contacts the surface of the photoconductive drum 15 at a position lower than the second edge 24*d*. Accordingly, an angle A open at the top is formed between the surface of the photoconductive drum 15 and a face of the leading end 24*a* of the second blade 24 that extends from the first edge 24*c* to the second edge 24*d*. A slight amount of the residual toner and the lubricant passing beneath the first blade 17 is accumulated in the angle A as illustrated in FIG. 3.

The second blade 24 is formed of the same material, for example, silicone rubber, as the first blade 17, and has the same width and thickness t as those of the first blade 17. The thickness t is in a range, for example, of between 1 mm and 3 mm. The second blade 24 is provided in the cartridge case 14 via the second blade holder 23 such that the angle A between the surface of the photoconductive drum 15 and the face of the leading end 24*a* is between 70° and 90°. In other words, the second blade 24 contacts the surface of the photoconductive drum 15 against the direction of rotation of the photoconductive drum 15.

The charger 31 includes a charging roller 26 that is pressed against the surface of the photoconductive drum 15 by a spring to charge the surface of the photoconductive drum 15. The charging roller 26 is rotatable in a counterclockwise direction in FIG. 2. The charger 31 further includes a cleaner roller 27 pressed against the charging roller 26 by a spring. The cleaner roller 27 is provided near the bottom of the photoconductive drum 15 and is rotated by the charging roller 26.

The developing device 32 includes a developing roller 28 to develop, with toner, an electrostatic latent image formed on the surface of the photoconductive drum 15 using light beams emitted from the irradiating device 6 and directed onto the surface of the photoconductive drum 15 through an opening of the cartridge case 14 formed between the charger 31 and the developing device 32. As a result, a toner image is formed on the surface of the photoconductive drum 15. The developing device 32 further includes a toner supply unit 29 and a pair of conveyance screws 30 that conveys the toner from the toner supply unit 29 to the developing roller 28. The developing device 32 is positioned on the left of the photoconductive drum 15 in FIG. 2.

A description is now given of operations of the image forming apparatus 100 according to illustrative embodiments with reference to FIGS. 1 and 2.

The photoconductive drum 15 is rotated in a clockwise direction in FIG. 1 by a driving means, not shown, and the charger 31 evenly charges the surface of the photoconductive drum 15 to a predetermined polarity. A light beam is directed onto the charged surface of the photoconductive drum 15 from the irradiating device 6 to form an electrostatic latent image on the surface of the photoconductive drum 15. It is to be noted that the light beam directed onto the surface of each of the photoconductive drums 15 includes image data of a specific color, that is, yellow, magenta, cyan, or black. The developing device 32 develops the electrostatic latent image with toner to form a toner image on the surface of the photoconductive drum 15.

The intermediate transfer belt 3 is rotated in a counterclockwise direction in FIG. 1, and the toner images of the respective colors respectively formed on the surfaces of the photoconductive drums 15 in the process cartridges 5 are sequentially transferred in a superimposed manner onto a surface of the intermediate transfer belt 3 by the primary transfer rollers 4. Accordingly, a full-color toner image is formed on the surface of the intermediate transfer belt 3. It is to be noted that, alternatively, only one of the process cartridges 5 may be used to form a single color image, or two or three of the process cartridges 5 may be used to form an image of two or three colors. In monochrome image formation, the process cartridge 5K positioned on the rightmost of the process cartridges 5 illustrated in FIG. 1 is used to form a monochrome image.

While the above-described operations are performed, a sheet is fed from the sheet tray 7 by the sheet feed roller 8. The sheet thus fed is conveyed to a secondary transfer position by the pair of registration rollers 10 in synchronization with movement of the full-color toner image borne on the surface of the intermediate transfer belt 3, and the full-color toner image is transferred onto the sheet by the secondary transfer roller 9. The sheet having the full-color toner image thereon is conveyed to the fixing device 11. Heat and pressure is applied to the full-color toner image so that the full-color toner image is melted and fixed onto the sheet. The sheet having the fixed full-color image thereon is then discharged to the discharge tray 12 by the pair of discharge rollers 13.

Meanwhile, in each of the process cartridges 5, most of the residual toner and the lubricant adhering to the surface of the photoconductive drum 15 after the toner image is transferred onto the intermediate transfer belt 3 are scrapped off by the first blade 17. The residual toner and the lubricant thus scrapped off are conveyed to the storage unit, not shown, by the first conveyance screw 18. It is to be noted that the brush roller 20 applies the lubricant 21 to the surface of the photoconductive drum 15 passing beneath the first blade 17.

In addition to the lubricant 21 supplied to the surface of the photoconductive drum 15 by the brush roller 20, a slight amount of the residual toner and the lubricant supplied for a previous series of image formation still remains on the surface of the photoconductive drum 15 even after passing beneath the first blade 17. Therefore, the second blade 24 scrapes off such slight amounts of the residual toner and the lubricant as remain, while at the same time evening out the lubricant 21 supplied to the surface of the photoconductive drum 15 by the brush roller 20. The residual toner and the lubricant thus scraped off by the second blade 24 are accumulated in the angle A formed by the surface of the photoconductive drum 15 and the face of the leading end 24*a* of the second blade 24 that extends from the first edge 24*c* to the second edge 24*d* as described above. Thereafter, overflowing residual toner and lubricant fall from the angle A and are conveyed to the storage unit, not shown, by the second conveyance screw 25.

The residual toner and the lubricant accumulated in the angle A improves slip between the second blade 24 and the surface of the photoconductive drum 15. Accordingly, problems such as chipping and curling of the second blade 24, noise, and abnormal friction can be prevented. Although improved slip may cause an extremely slight amount of the residual toner to pass beneath the second blade 24, an amount, a particle size, and a shape of such toner do not affect image quality.

The first blade 17, the brush roller 20, and the second blade 24 are arranged in that order from the primary transfer position on the surface of the photoconductive drum 15 to the downstream relative to the direction of rotation of the photoconductive drum 15. Accordingly, a certain amount of the lubricant 21 supplied to the surface of the photoconductive drum 15 and scrapped off by the second blade 24 constantly remains in the angle A. As a result, even when the lubricant 21 is not evenly supplied to the surface of the photoconductive drum 15, the second blade 24 can spread the lubricant 21 evenly over the surface of the photoconductive drum 15.

The surface of the photoconductive drum 15 passing beneath the cleaning device 50 is again evenly charged to a predetermined polarity by the charger 31 as described above to be ready for the next sequence of image formation.

A description is now given of toner used in the image forming apparatus 100 according to illustrative embodiments.

The toner used in the image forming apparatus 100 according to illustrative embodiments preferably has a volume average particle diameter (Dv) of from 3 μm to 8 μm, and a ratio (Dv/Dn) of the volume average particle diameter (Dv) to the number average particle diameter (Dn) of from 1.00 to 1.40. Such a toner can be uniformly charged and transferred, and therefore high quality images without background fogging can be produced, and a higher transfer rate can be achieved in the image forming apparatus 100 employing the electrostatic transfer system.

In order to satisfy increasing demand for higher quality images, a volume average particle diameter (Dv) of the toner is preferably in a range between 3 μm and 8 μm as described above to reproduce microdots not less than 600 dpi. Also as described above, a ratio (Dv/Dn) of the volume average particle diameter (Dv) to the number average particle diameter (Dn) of the toner is preferably in a range between 1.00 and 1.40. As the ratio (Dv/Dn) approaches 1, the particle diameter distribution becomes narrower. The toner having a smaller particle diameter and a narrower particle diameter distribution can be uniformly charged and transferred, and therefore high quality images without background fogging can be produced, and a higher transfer rate can be achieved in the image forming apparatus 100 employing the electrostatic transfer system.

The toner having high circularity with a shape factor SF-1 of from 100 to 180 and a shape factor SF-2 of from 100 to 180 is used in the image forming apparatus 100 according illustrative embodiments. When a shape of the toner particle becomes close to a sphere, toner particles contact each other as well as the photoconductive drum 15 in a point contact manner. As a result, absorbability between the toner particles decreases, resulting in an increase in fluidity. Moreover, absorbability between the toner and the photoconductive drum 15 decreases, resulting in an increase in a transfer rate. The use of a toner particle with the shape factors SF-1 and SF-2 of more than 180 is not preferable due to a decrease in the transfer rate. Therefore, each of the shape factors SF-1 and SF-2 is preferably set in a range between 100 and 180 to increase the transfer rate.

Figure 4A:
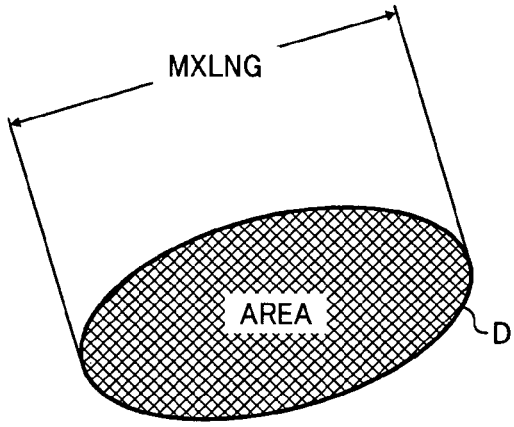
FIG. 4A is a view illustrating a shape of toner for explaining a shape factor SF-1 of the toner used in the image forming apparatus illustrated in FIG. 1.
Figure 4B:
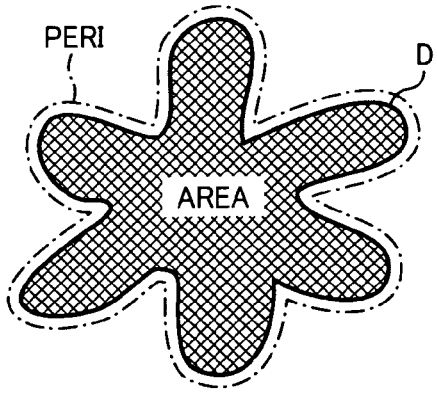
FIG. 4B is a view illustrating a shape of toner for explaining a shape factor SF-2 of the toner used in the image forming apparatus illustrated in FIG. 1.

As described above, the toner preferably has a shape factor SF-1 of from 100 to 180, and a shape factor SF-2 of from 100 to 180. FIGS. 4A and 4B are schematic views each illustrating a shape of toner D for explaining the shape factors SF-1 and SF-2, respectively.

As illustrated in FIG. 4A, the shape factor SF-1 represents a degree of roundness of a toner particle, and is determined in accordance with the following formula (1).

$$SF\text{-}1=\{(MXLNG)^2/AREA\}\times(100\pi/4) \quad (1)$$

The shape factor SF-1 is obtained by dividing the square of the maximum length MXLNG of the shape produced by projecting the toner particle in a two-dimensional plane, by the figural surface area AREA, and subsequently multiplying by 100π/4. When SF-1 is 100, the toner particle has a shape of a complete sphere. As SF-1 becomes greater, the toner particle becomes more amorphous.

As illustrated in FIG. 4B, the shape factor SF-2 represents a concavity and convexity of the shape of the toner particle, and is determined in accordance with the following formula (2).

$$SF\text{-}2=\{(PELI)^2/AREA\}\times(100\pi/4) \quad (2)$$

The shape factor SF-2 is obtained by dividing the square of the perimeter PERI of the figure produced by projecting the toner particle in a two-dimensional plane, by the figural surface area AREA, and subsequently multiplying by 100π/4.

When SF-2 is 100, the surface of the toner particle has no concavities and convexities. As SF-2 becomes greater, the concavities and convexities thereon become more noticeable. The shape factors can be measured by taking a picture of the toner particle with a scanning electron microscope S-800 manufactured by Hitachi, Ltd., and analyzing the picture with an image analyzer LUSEX 3 manufactured by Nireco Corporation to calculate the shape factors.

When a shape of the toner particle becomes close to a sphere, toner particles contact each other as well as the photoconductive drum 15 in a point contact manner. Consequently, absorbability between the toner particles decreases, resulting in an increase in fluidity. Moreover, absorbability between the toner particles and the photoconductive drum 15 decreases, resulting in an increase in a transfer rate. When either the shape factor SF-1 or SF-2 is too large, the transfer rate deteriorates.

The toner preferably used for image formation performed by the image forming apparatus 100 is obtained by a crosslinking reaction and/or an elongation reaction of a toner constituent liquid in an aqueous solvent. Here, the toner constituent liquid is prepared by dispersing a polyester prepolymer including a functional group having at least a nitrogen atom, a polyester, colorant, and a releasing agent in an organic solvent.

A description is now given of toner constituents and a method for manufacturing toner.

(Polyester)

The polyester is prepared by a polycondensation reaction between a polyalcohol compound and a polycarboxylic acid compound. Specific examples of the polyalcohol compound (PO) include a diol (DIO) and a polyol having 3 or more valances (TO). The DIO alone, and a mixture of the DIO and a smaller amount of the TO are preferably used as the PO. Specific examples of the diol (DIO) include alkylene glycols (e.g., ethylene glycol, 1,2-propylene glycol, 1,3-propylene glycol, 1,4-butanediol, and 1,6-hexanediol), alkylene ether glycols (e.g., diethylene glycol, triethylene glycol, dipropyrene glycol, polyethylene glycol, polypropylene glycol, and polytetramethylene ether glycol), alicyclic diols (e.g., 1,4-cyclohexane dimethanol, and hydrogenated bisphenol A), bisphenols (e.g., bisphenol A, bisphenol F, and bisphenol S), alkylene oxide adducts of the above-described alicyclic diols (e.g., ethylene oxide, propylene oxide, and butylene oxide), and alkylene oxide adducts of the above-described bisphenols (e.g., ethylene oxide, propylene oxide, and butylene oxide). Among the above-described examples, alkylene glycols having 2 to 12 carbon atoms and alkylene oxide adducts of bisphenols are preferably used. More preferably, the alkylene glycols having 2 to 12 carbon atoms and the alkylene oxide adducts of bisphenols are used together. Specific examples of the polyol having 3 or more valances (TO) include aliphatic polyols having 3 to 8 or more valances (e.g., glycerin, trimethylolethane, trimethylol propane, pentaerythritol, and sorbitol), phenols having 3 or more valances (e.g., trisphenol PA, phenol novolac, and cresol novolac), and alkylene oxide adducts of polyphenols having 3 or more valances.

Specific examples of the polycarboxylic acids (PC) include dicarboxylic acids (DIC) and polycarboxylic acids having 3 or more valances (TC). The DIC alone, and a mixture of the DIC and a smaller amount of the TC are preferably used as the PC. Specific examples of the dicarboxylic acids (DIC) include alkylene dicarboxylic acids (e.g., succinic acid, adipic acid, and sebacic acid), alkenylene dicarboxylic acids (e.g., maleic acid and fumaric acid), and aromatic dicarboxylic acids (e.g., phthalic acid, isophthalic acid, terephthalic acid, and naphthalene dicarboxylic acid). Among the above-described examples, alkenylene dicarboxylic acids having 4 to 20 carbon atoms and aromatic dicarboxylic acids having 8 to 20 carbon atoms are preferably used. Specific examples of the polycarboxylic acids having 3 or more valances (TC) include aromatic polycarboxylic acids having 9 to 20 carbon atoms (e.g., trimellitic acid and pyromellitic acid). The polycarboxylic acid (PC) may be reacted with the polyol (PO) using acid anhydrides or lower alkyl esters (e.g., methyl ester, ethyl ester, and isopropyl ester) of the above-described materials.

A ratio of the polyol (PO) and the polycarboxylic acid (PC) is normally set in a range between 2/1 and 1/1, preferably between 1.5/1 and 1/1, and more preferably between 1.3/1 and 1.02/1 as an equivalent ratio [OH]/[COOH] between a hydroxyl group [OH] and a carboxyl group [COOH].

The polycondensation reaction between the polyol (PO) and the polycarboxylic acid (PC) is carried out by heating the PO and the PC to from 150° C. to 280° C. in the presence of a known catalyst for esterification such as tetrabutoxy titanate and dibutyltin oxide and removing produced water under a reduced pressure as necessary to obtain a polyester having hydroxyl groups. The polyester preferably has a hydroxyl value not less than 5, and an acid value of from 1 to 30, and preferably from 5 to 20. When the polyester has the acid value within the range, the resultant toner tends to be negatively charged to have good affinity with a recording paper, and lower-temperature fixability of the toner on the recording paper improves. However, when the acid value is too large, the resultant toner is not stably charged and the stability becomes worse by environmental variations.

The polyester preferably has a weight-average molecular weight of from 10,000 to 400,000, and more preferably from 20,000 to 200,000. When the weight-average molecular weight is too small, offset resistance of the resultant toner deteriorates. By contrast, when the weight-average molecular weight is too large, lower-temperature fixability thereof deteriorates.

The polyester preferably includes a urea-modified polyester as well as an unmodified polyester obtained by the above-described polycondensation reaction. The urea-modified polyester is prepared by reacting a polyisocyanate compound (PIC) with a carboxyl group or a hydroxyl group at the end of the polyester obtained by the above-described polycondensation reaction to form a polyester prepolymer (A) having an isocyanate group, and reacting amine with the polyester prepolymer (A) to crosslink and/or elongate a molecular chain thereof.

Specific examples of the polyisocyanate compound (PIC) include aliphatic polyisocyanates (e.g., tetramethylene diisocyanate, hexamethylene diisocyanate, and 2,6-diisocyanate methylcaproate), alicyclic polyisocyanates (e.g., isophoron diisocyanate and cyclohexyl methane diisocyanate), aromatic diisocyanates (e.g., trilene diisocyanate and diphenylmethane diisocyanate), aromatic aliphatic diisocyanates (e.g., α, α, α', α'-tetramethyl xylylene diisocyanate), isocyanurates, materials blocked against the polyisocyanate with phenol derivatives, oxime, caprolactam or the like, and combinations of two or more of the above-described materials.

The PIC is mixed with the polyester such that an equivalent ratio [NCO]/[OH] between an isocyanate group [NCO] in the PIC and a hydroxyl group [OH] in the polyester is typically in a range between 5/1 and 1/1, preferably between 4/1 to 1.2/1, and more preferably between 2.5/1 to 1.5/1. When [NCO]/[OH] is too large, lower-temperature fixability of the resultant toner deteriorates. When [NCO]/[OH] is too small, a urea content in ester of the modified polyester decreases and hot offset resistance of the resultant toner deteriorates.

The polyester prepolymer (A) typically includes a polyisocyanate group of from 0.5 to 40% by weight, preferably from 1 to 30% by weight, and more preferably from 2 to 20% by weight. When the content is too small, hot offset resistance of the resultant toner deteriorates, and in addition, the heat resistance and lower-temperature fixability of the toner also deteriorate. By contrast, when the content is too large, lower-temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is too small per 1 molecule, the molecular weight of the urea-modified polyester decreases and hot offset resistance of the resultant toner deteriorates.

Specific examples of amines (B) reacted with the polyester prepolymer (A) include diamines (B1), polyamines (B2) having 3 or more amino groups, amino alcohols (B3), amino mercaptans (B4), amino acids (B5), and blocked amines (B6) in which the amines (B1 to B5) described above are blocked.

Specific examples of the diamines (B1) include aromatic diamines (e.g., phenylene diamine, diethyltoluene diamine, and 4,4'-diaminodiphenyl methane), alicyclic diamines (e.g., 4,4'-diamino-3,3'-dimethyldicyclohexylmethane, diamine cyclohexane, and isophoron diamine), and aliphatic diamines (e.g., ethylene diamine, tetramethylene diamine, and hexamethylene diamine).

Specific examples of the polyamines (B2) having three or more amino groups include diethylene triamine and triethylene tetramine. Specific examples of the amino alcohols (B3) include ethanol amine and hydroxyethyl aniline. Specific examples of the amino mercaptan (B4) include aminoethyl mercaptan and aminopropyl mercaptan.

Specific examples of the amino acids (B5) include amino propioic acid and amino caproic acid. Specific examples of the blocked amines (B6) include ketimine compounds prepared by reacting one of the amines B1 to B5 described above with a ketone such as acetone, methyl ethyl ketone and methyl isobutyl ketone; and oxazoline compounds. Among the above-described amines (B), diamines (B1) and a mixture of the B1 and a smaller amount of B2 are preferably used.

A mixing ratio [NCO]/[NHx] of the content of isocyanate groups in the prepolymer (A) to that of amino groups in the amine (B) is typically from 1/2 to 2/1, preferably from 1.5/1 to 1/1.5, and more preferably from 1.2/1 to 1/1.2. When the mixing ratio is too large or small, molecular weight of the urea-modified polyester decreases, resulting in deterioration of hot offset resistance of the toner.

The urea-modified polyester may include a urethane bonding as well as a urea bonding. The molar ratio (urea/urethane) of the urea bonding to the urethane bonding is typically from 100/0 to 10/90, preferably from 80/20 to 20/80, and more preferably from 60/40 to 30/70. When the content of the urea bonding is too small, hot offset resistance of the resultant toner deteriorates.

The urea-modified polyester is prepared by a method such as a one-shot method. The PO and the PC are heated to from 150° C. to 280° C. in the presence of a known esterification catalyst such as tetrabutoxy titanate and dibutyltin oxide, and removing produced water while optionally depressurizing to prepare polyester having a hydroxyl group. Next, the polyisocyanate (PIC) is reacted with the polyester at from 40° C. to 140° C. to form a polyester prepolymer (A) having an isocyanate group. Further, the amines (B) are reacted with the polyester prepolymer (A) at from 0° C. to 140° C. to form a urea-modified polyester.

When the polyisocyanate (PIC), and the polyester prepolymer (A) and the amines (B) are reacted, a solvent may optionally be used. Specific examples of the solvents include inactive solvents with the PIC such as aromatic solvents (e.g., toluene and xylene), ketones (e.g., acetone, methyl ethyl ketone and methyl isobutyl ketone), esters (e.g., ethyl acetate), amides (e.g., dimethylformamide and dimethylacetamide), and ethers (e.g., tetrahydrofuran).

A reaction terminator may optionally be used in the cross-linking and/or the elongation reaction between the polyester prepolymer (A) and the amines (B) to control a molecular weight of the resultant urea-modified polyester. Specific examples of the reaction terminators include monoamines (e.g., diethylamine, dibutylamine, butylamine and laurylamine), and their blocked compounds (e.g., ketimine compounds).

The weight-average molecular weight of the urea-modified polyester is not less than 10,000, preferably from 20,000 to 10,000,000, and more preferably from 30,000 to 1,000,000. When the weight-average molecular weight is too small, hot offset resistance of the resultant toner deteriorates. The number-average molecular weight of the urea-modified polyester is not particularly limited when the above-described unmodified polyester resin is used in combination. Specifically, the weight-average molecular weight of the urea-modified polyester resins has priority over the number-average molecular weight thereof. However, when the urea-modified polyester is used alone, the number-average molecular weight is from 2,000 to 15,000, preferably from 2,000 to 10,000, and more preferably from 2,000 to 8,000. When the number-average molecular weight is too large, low temperature fixability of the resultant toner and glossiness of full color images deteriorate.

A combination of the urea-modified polyester and the unmodified polyester improves low temperature fixability of the resultant toner and glossiness of color images produced thereby, and is more preferably used than using the urea-modified polyester alone. Further, the unmodified polyester may include modified polyester other than the urea-modified polyester.

It is preferable that the urea-modified polyester at least partially mixes with the unmodified polyester to improve the low temperature fixability and hot offset resistance of the resultant toner. Therefore, the urea-modified polyester preferably has a composition similar to that of the unmodified polyester.

A mixing ratio between the unmodified polyester and the urea-modified polyester is from 20/80 to 95/5, preferably from 70/30 to 95/5, more preferably from 75/25 to 95/5, and even more preferably from 80/20 to 93/7. When the content of the urea-modified polyester is too small, the hot offset resistance deteriorates, and in addition, it is disadvantageous to have both high temperature preservability and low temperature fixability.

The binder resin including the unmodified polyester and urea-modified polyester preferably has a glass transition temperature (Tg) of from 45° C. to 65° C., and preferably from 45° C. to 60° C. When the glass transition temperature is too low, the high temperature preservability of the toner deteriorates. By contrast, when the glass transition temperature is too high, the low temperature fixability deteriorates.

Because the urea-modified polyester is likely to be present on a surface of the parent toner, the resultant toner has better heat resistance preservability than known polyester toners even though the glass transition temperature of the urea-modified polyester is low.

(Colorant)

Specific examples of the colorants for use in the toner of the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials can be used alone or in combination. The toner preferably includes a colorant in an amount of from 1 to 15% by weight, and more preferably from 3 to 10% by weight.

The colorant for use in the present invention can be combined with a resin to be used as a master batch. Specific examples of the resin for use in the master batch include, but are not limited to, styrene polymers and substituted styrene polymers (e.g., polystyrenes, poly-p-chlorostyrenes, and polyvinyltoluenes), copolymers of vinyl compounds and the above-described styrene polymers or substituted styrene polymers, polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acids, rosins, modified rosins, terpene resins, aliphatic or alicyclic hydrocarbon resins, aromatic petroleum resins, chlorinated paraffins, paraffin waxes, etc. These resins can be used alone or in combination.

(Charge Controlling Agent)

The toner of the present invention may optionally include a charge controlling agent.

Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and salicylic acid derivatives, but are not limited thereto.

Specific examples of commercially available charge controlling agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among the above-described examples, materials negatively charging the toner are preferably used.

The content of the charge controlling agent is determined depending on the species of the binder resin used, and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity, and thereby the electrostatic force of a developing roller attracting the toner increases, resulting in deterioration of the fluidity of the toner and image density of the toner images.

(Release Agent)

A wax for use in the toner as a release agent has a low melting point of from 50° C. to 120° C. When such a wax is included in the toner, the wax is dispersed in the binder resin and serves as a release agent at a location between a fixing roller and the toner particles. Accordingly, hot offset resistance can be improved without applying a release agent, such as oil, to the fixing roller. Specific examples of the release agent include natural waxes including vegetable waxes such as carnauba wax, cotton wax, Japan wax and rice wax; animal waxes such as bees wax and lanolin; mineral waxes such as ozokelite and ceresine; and petroleum waxes such as paraffin waxes, microcrystalline waxes, and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes, and ether waxes. Further, fatty acid amides such as 1,2-hydroxylstearic acid amide, stearic acid amide, and phthalic anhydride imide; and low molecular weight crystalline polymers such as acrylic homopolymer and copolymers having a long alkyl group in their side chain such as poly-n-stearyl methacrylate, poly-n-laurylmethacrylate, and n-stearyl acrylate-ethyl methacrylate copolymers can also be used.

The above-described charge control agents and release agents can be dissolved and dispersed after kneaded upon application of heat together with a master batch pigment and a binder resin, and can be added when directly dissolved or dispersed in an organic solvent.

(External Additives)

The toner particles are preferably mixed with an external additive to assist in improving the fluidity, developing property and charging ability of the toner particles. Preferable external additives include inorganic fine particles. The inorganic fine particles preferably have a primary particle diameter of from $5\times10^{-3}$ to 2 μm, and more preferably from $5\times10^{-3}$ to 0.5 μm. In addition, the inorganic fine particles preferably has a specific surface area measured by a BET method of from 20 to 500 $m^2/g$. The content of the external additive is preferably from 0.01 to 5% by weight, and more preferably from 0.01 to 2.0% by weight, based on total weight of the toner composition.

Specific examples of the inorganic fine particles include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among the above-described examples, a combination of a hydrophobic silica and a hydrophobic titanium oxide is preferably used. In particular, the hydrophobic silica and the hydrophobic titanium oxide each having an average particle diameter of not greater than $5\times10^{-2}$ μm considerably improves an electrostatic force between the toner particles and van der Waals force. Accordingly, the resultant toner composition has a proper charge quantity. In addition, even when the toner composition is agitated in the developing device 32, the external additive is hardly released from the toner particles. As a result, image defects such as white spots and image omissions are hardly produced. Further, the amount of the toner particles remaining on the photoconductive drum 15 after transfer can be reduced.

When titanium oxide fine particles are used as the external additive, the resultant toner can reliably form toner images having a proper image density even when environmental conditions are changed. However, the charge rising properties of the resultant toner tend to deteriorate. Therefore, an additive amount of the titanium oxide fine particles is preferably smaller than that of silica fine particles.

The total additive amount of hydrophobic silica fine particles and hydrophobic titanium oxide fine particles is preferably from 0.3 to 1.5% by weight based on weight of the toner particles to reliably form higher-quality images without degrading charge rising properties even when images are repeatedly formed.

A method for manufacturing the toner is described in detail below, but is not limited thereto.

(Method for Manufacturing Toner)

(1) The colorant, the unmodified polyester, the polyester prepolymer having an isocyanate group, and the release agent are dispersed in an organic solvent to obtain toner constituent liquid. From the viewpoint of easy removal after formation of parent toner particles, it is preferable that the organic solvent be volatile and have a boiling point of not greater than 100° C. Specific examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethylketone, and methylisobutylketone. The above-described materials can be used alone or in combination. In particular, aromatic solvent such as toluene and xylene, and chlorinated hydrocarbon such as methylene chloride, 1,2-dichloroethane, chloroform, and carbon tetrachloride are preferably used. The toner constituent liquid preferably includes the organic solvent in an amount of from 0 to 300 parts by weight, more preferably from 0 to 100 parts by weight, and even more preferably from 25 to 70 parts by weight based on 100 parts by weight of the prepolymer.

(2) The toner constituent liquid is emulsified in an aqueous medium under the presence of a surfactant and a particulate resin. The aqueous medium may include water alone or a mixture of water and an organic solvent. Specific examples of the organic solvent include alcohols such as methanol, isopropanol, and ethylene glycol; dimethylformamide; tetrahydrofuran; cellosolves such as methyl cellosolve; and lower ketones such as acetone and methyl ethyl ketone.

The toner constituent liquid includes the aqueous medium in an amount of from 50 to 2,000 parts by weight, and preferably from 100 to 1,000 parts by weight based on 100 parts by weight of the toner constituent liquid. When the amount of the aqueous medium is too small, the toner constituent liquid is not well dispersed and toner particles having a predetermined particle diameter cannot be formed. By contrast, when the amount of the aqueous medium is too large, production costs increase.

A dispersant such as a surfactant or an organic particulate resin is optionally included in the aqueous medium to improve the dispersion therein.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives, and imidazoline) and quaternary ammonium salts (e.g., alkyltrimethyl ammonium salts, dialkyldimethyl ammonium salts, alkyldimethyl benzyl ammonium salts, pyridinium salts, alkyl isoquinolinium salts, and benzethonium chloride); nonionic surfactants such as fatty acid amide derivatives and polyhydric alcohol derivatives; and ampholytic surfactants such as alanine, dodecyldi(aminoethyl)glycin, di(octylaminoethyle)glycin, and N-alkyl-N,N-dimethylammonium betaine.

A surfactant having a fluoroalkyl group can achieve a dispersion having high dispersibility even when a smaller amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-[ω-fluoroalkyl(C6-C11)oxy]-1-alkyl(C3-C4) sulfonate, sodium-[ω-fluoroalkanoyl(C6-C8)-N-ethylamino]-1-propane sulfonate, fluoroalkyl(C11-C20) carboxylic acids and their metal salts, perfluoroalkylcarboxylic acids (C7-C13) and their metal salts, perfluoroalkyl(C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin, and monoperfluoroalkyl(C6-C16) ethylphosphates.

Specific examples of commercially available surfactants include SURFLON® S-111, SURFLON® S-112, and SURFLON® S-113 manufactured by AGC Seimi Chemical Co., Ltd.; FRORARD FC-93, FC-95, FC-98, and FC-129 manufactured by Sumitomo 3M Ltd.; UNIDYNE DS-101 and DS-102 manufactured by Daikin Industries, Ltd.; MEGA- FACE F-110, F-120, F-113, F-191, F-812, and F-833 manufactured by DIC Corporation; EFTOP EF-102, EF-103, EF-104, EF-105, EF-112, EF-123A, EF-123B, EF-306A, EF-501, EF-201, and EF-204 manufactured by JEMCO Inc.; and FUTARGENT F-100 and F-150 manufactured by Neos Co., Ltd.

Specific examples of cationic surfactants include primary and secondary aliphatic amines or secondary amino acid having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, and imidazolinium salts. Spedific examples of commercially available products thereof include SURFLON® S-121 manufactured by AGC Seimi Chemical Co., Ltd.; FRORARD FC-135 manufactured by Sumitomo 3M Ltd.; UNIDYNE DS-202 manufactured by Daikin Industries, Ltd.; MEGAFACE F-150 and F-824 manufactured by DIC Corporation; EFTOP EF-132 manufactured by JEMCO Inc.; and FUTARGENT F-300 manufactured by Neos Co., Ltd.

The resin particles are added to stabilize parent toner particles formed in the aqueous medium. Therefore, the resin particles are preferably added so as to have a coverage of from 10 to 90% over a surface of the parent toner particles. Specific examples of the resin particles include polymethylmethacrylate particles having a particle diameter of 1 μm and 3 μm, polystyrene particles having a particle diameter of 0.5 μm and 2 μm, and poly(styrene-acrylonitrile) particles having a particle diameter of 1 μm. Specific examples of commercially available products thereof include PB-200H manufactured by Kao Corporation, SGP manufactured by Soken Chemical & Engineering Co., Ltd., Technopolymer SB manufactured by Sekisui Plastics Co., Ltd., SGP-3G manufactured by Soken Chemical & Engineering Co., Ltd., and Micropearl from Sekisui Chemical Co., Ltd.

In addition, inorganic dispersants such as tricalcium phosphate, calcium carbonate, titanium oxide, colloidal silica, and hydroxy apatite can also be used.

As dispersants which can be used in combination with the above-described resin particles and inorganic dispersants, it is possible to stably disperse toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid, and maleic anhydride), (meth)acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide, and N-methylolmethacrylamide), vinyl alcohol and its ethers (e.g., vinyl methyl ether, vinyl ethyl ether, and vinyl propyl ether), esters of vinyl alcohol with a compound having a carboxyl group (e.g., vinyl acetate, vinyl propionate, and vinyl butyrate), acrylic amides (e.g., acrylamide, methacrylamide, and diacetoneacrylamide) and their methylol compounds, acid chlorides (e.g., acrylic acid chloride and methacrylic acid chloride), nitrogen-containing compounds (e.g., vinyl pyridine, vinyl pyrrolidone, vinyl imidazole, and ethylene imine), and homopolymer or copolymer having heterocycles of the nigtroge-containnig compounds. In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds (e.g., methyl cellulose, hydroxyethyl cellulose, and hydroxypropyl cellulose) can also be used as the polymeric protective colloid.

The dispersion method is not particularly limited, and well-known methods such as low speed shearing methods, high-speed shearing methods, friction methods, high-pressure jet methods, and ultrasonic methods can be used. Among the above-described methods, the high-speed shearing methods are preferably used because particles having a particle diameter of from 2 to 20 μm can be easily prepared. When a high-speed shearing type dispersion machine is used, the rotation speed is not particularly limited, but the rotation speed is typically from 1,000 to 30,000 rpm, and preferably from 5,000 to 20,000 rpm. The dispersion time is not particularly limited, but is typically from 0.1 to 5 minutes for a batch method. The temperature in the dispersion process is typically from 0° C. to 150° C. (under pressure), and preferably from 40° C. to 98° C.

(3) While the emulsion is prepared, amines (B) are added thereto to react with the polyester prepolymer (A) having an isocyanate group. This reaction is accompanied by cross-linking and/or elongation of a molecular chain. The reaction time depends on reactivity of an isocyanate structure of the polyester prepolymer (A) and amines (B), but is typically from 10 minutes to 40 hours, and preferably from 2 to 24 hours. The reaction temperature is typically from 0° C. to 150° C., and preferably from 40° C. to 98° C. In addition, a known catalyst such as dibutyltinlaurate and dioctyltinlaurate can be used as needed.

(4) After completion of the reaction, the organic solvent is removed from the emulsified dispersion (a reactant), and subsequently, the resulting material is washed and dried to obtain a parent toner particle. The prepared emulsified dispersion is gradually heated while stirred in a laminar flow, and an organic solvent is removed from the dispersion after stirred strongly when the dispersion has a specific temperature to form a parent toner particle having the shape of a spindle. When an acid such as calcium phosphate or a material soluble in alkaline is used as a dispersant, the calcium phosphate is dissolved with an acid such as a hydrochloric acid, and washed with water to remove the calcium phosphate from the parent toner particle. Besides the above-described method, the organic solvent can also be removed by an enzymatic hydrolysis.

(5) A charge control agent is provided to the parent toner particle, and inorganic fine particles such as silica fine particles and titanium oxide fine particles are added thereto to obtain toner. Well-known methods using a mixer or the like are used to provide the charge control agent and to add the inorganic fine particles.

Accordingly, toner having a smaller particle diameter and a sharper particle diameter distribution can be easily obtained. Further, the strong agitation in the process of removing the organic solvent can control the toner to have a shape between a spherical shape and a spindle shape, and a surface morphology between a smooth surface and a rough surface.

The toner used in the image forming apparatus 100 according to illustrative embodiments has a substantially spherical shape that can be defined as follows. The toner has a substantially spherical shape having a long axis r1, a short axis r2, and a thickness r3 that satisfy a relationship of r1≧r2≧r3. A ratio (r2/r1) of the short axis r2 to the long axis r1 is in a range between 0.5 and 1.0, and a ratio (r3/r2) of the thickness r3 to the short axis r2 is in a range between 0.7 and 1.0.

Figure 5A:
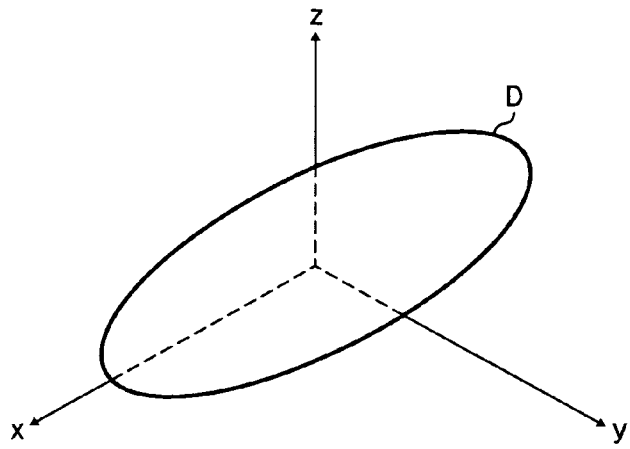
FIG. 5A is a view illustrating a long axis, a short axis, and a thickness of the toner.
Figure 5B:
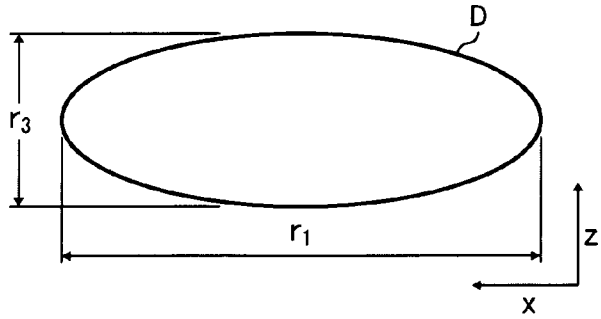
FIG. 5B is a view illustrating a ratio of the short axis to the long axis of the toner.
Figure 5C:
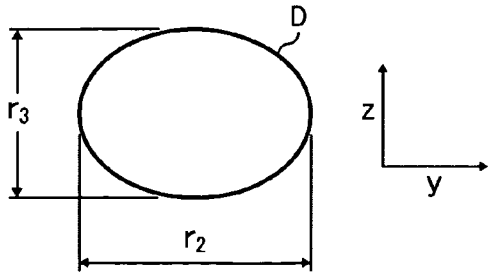
FIG. 5C is a view illustrating a ratio of the thickness to the short axis of the toner.

FIGS. 5A to 5C are schematic views respectively illustrating a shape of the toner D.

As illustrated in FIG. 5A, the toner D has a substantially spherical shape with a long axis r1, a short axis r2, and a thickness r3 that satisfy a relationship of r1≧r2≧r3. As illustrated in FIG. 5B, it is preferable that a ratio (r2/r1) of the short axis r2 to the long axis r1 be in a range between 0.5 and 1.0, and as illustrated in FIG. 5C, a ratio (r3/r2) of the thickness r3 to the short axis r2 be in a range between 0.7 and 1.0.

When the ratio (r2/r1) of the short axis r2 to the long axis r1 is less than 0.5, a shape of the toner D is not spherical, and both dot-reproductivity and transfer efficiency are decreased. Consequently, higher image quality cannot be obtained. When the ratio (r3/r2) of the thickness r3 to the short axis r2 is less than 0.7, a shape of the toner D is flattened. Consequently, a high transfer ratio as obtained when the toner D is spherical cannot be achieved. In particular, when the ratio (r3/r2) of the thickness r3 to the short axis r2 is 1.0, the toner D is rotated around the long axis r1 as a rotary shaft, thereby improving flowability of the toner D.

Each of r1, r2, r3 is measured by taking pictures of the toner D by a scanning electron microscope (SEM) at different viewing angles.

Accordingly, as described above, a shape of the toner used in the image forming apparatus 100 according to illustrative embodiments has a substantially spherical, so that both dot-reproductivity and transfer efficiency can be improved. In particular, the ratio (r2/r1) of the short axis r2 to the long axis r1 is set in a range between 0.5 and 1.0, and the ratio (r3/r2) of the thickness r3 to the short axis r2 is set in a range between 0.7 and 1.0 when a relation of r1≧r2≧r3 is satisfied, so that a shape of the toner is spherical. As a result, both dot-reproductivity and transfer efficiency can be improved, thereby providing higher image quality.

According to the foregoing illustrative embodiments, the angle A is formed facing up, that is, open at the top, between the surface of the photoconductive drum 15 and the face of the leading end 24*a* of the second blade 24, that is, extending from the first edge 24*c* to the second edge 24*d*, so that the residual toner and the lubricant scraped off by the second blade 24 are accumulated in the angle A. The residual toner and the lubricant thus accumulated in the angle A improves slip between the second blade 24 and the surface of the photoconductive drum 15. Accordingly, problems such as chipping and curling of the second blade 24, noise, and abnormal friction can be prevented. In addition, a certain amount of the lubricant 21 supplied to the surface of the photoconductive drum 15 by the brush roller 20 and scraped off by the second blade 24 constantly remains in the angle A. Therefore, even when the lubricant 21 is not evenly supplied to the surface of the photoconductive drum 15, the second blade 24 can spread the lubricant 21 evenly over the surface of the photoconductive drum 15.

According to the foregoing illustrative embodiments, the brush roller 20 that supplies the lubricant 21 to the surface of the photoconductive drum 15 is separated from the second blade 24 between the first and second blades 17 and 24. Accordingly, the residual toner passing beneath the first blade 17 and the brush roller 20 can be scraped off by the second blade 24. Further, because the second blade 24 is elastically deformable sufficiently, the lubricant 21 supplied to the surface of the photoconductive drum 15 can be reliably leveled.

It is to be noted that illustrative embodiments of the present invention are not limited to those described above, and various modifications and improvements are possible without departing from the scope of the present invention. It is therefore to be understood that, within the scope of the associated claims, illustrative embodiments may be practiced otherwise than as specifically described herein. For example, elements and/or features of different illustrative embodiments may be combined with each other and/or substituted for each other within the scope of the illustrative embodiments.

For example, although the lubricant applicator 53 is provided between the first and second cleaning units 51 and 52 in the foregoing illustrative embodiments, alternatively, the present invention is applicable to a cleaning device without a lubricant applicator.

Further alternatively, a process cartridge including a photoconductive drum, a cleaning device, and one of a charger and a developing device may be used in place of the process cartridges 5 each including the photoconductive drum 15, the cleaning device 50, the charger 31, and the developing device 32 according to the foregoing illustrative embodiments.

What is claimed is:

1. A cleaning device, comprising:

a first blade contacting a surface of an image carrier rotatable to carry a toner image to be transferred onto a transfer body; and a second blade separate from the first blade to contact the surface of the image carrier at a position downstream from the first blade in a direction of rotation of the image carrier relative to a transfer position on the surface of the image carrier where the toner image is transferred onto the transfer body, a leading end of the second blade positioned upstream from a trailing end of the second blade relative to the direction of rotation of the image carrier and facing up, and a first edge of the leading end of the second blade contacting the surface of the image carrier at a point on the surface of the image carrier below a second edge of the leading end of the second blade, wherein a face of the leading end of the second blade, provided between the first edge and the second edge, is perpendicular to each of the first and second edges of the second blade.

2. The cleaning device according to claim 1, further comprising a lubricant applicator to apply a lubricant to the surface of the image carrier, the lubricant applicator disposed between the first blade and the second blade.

3. The cleaning device according to claim 2, wherein the lubricant applicator comprises a brush roller.

4. The cleaning device according to claim 1, wherein the first blade and the second blade are made from the same material.

5. The cleaning device according to claim 4, wherein the material is silicon rubber.

6. The cleaning device according to claim 1, wherein the first blade and the second blade have the same width and thickness.

7. The cleaning device according to claim 6, wherein the thickness of the first and second blades is between 1 mm and 3 mm.

8. The cleaning device according to claim 1, wherein the second blade is provided on a cartridge casing such that an angle between the surface of the image carrier and the face of the leading end of the second blade is between 70° and 90°.

9. A process cartridge detachably attachable to an image forming apparatus, the process cartridge comprising:

an image carrier rotatable to carry a toner image to be transferred onto a transfer body;

one of a charger to charge a surface of the image carrier and a developing device to develop an electrostatic latent image formed on the surface of the image carrier with toner; and a cleaning device, the cleaning device including:

a first blade contacting the surface of the image carrier; and a second blade separate from the first blade to contact the surface of the image carrier at a position downstream from the first blade in a direction of rotation of the image carrier relative to a transfer position on the surface of the image carrier where the toner image is transferred onto the transfer body, a leading end of the second blade positioned upstream from a trailing end of the second blade relative to the direction of rotation of the image carrier and facing up, and a first edge of the leading end of the second blade contacting the surface of the image carrier at a point on the surface of the image carrier below a second edge of the leading end of the second blade, wherein a face of the leading end of the second blade, provided between the first edge and the second edge, is perpendicular to each of the first and second edges of the second blade.

10. An image forming apparatus having a process cartridge detachably attachable to the image forming apparatus, the process cartridge comprising:

an image carrier rotatable to carry a toner image to be transferred onto a transfer body;

one of a charger to charge a surface of the image carrier and a developing device to develop an electrostatic latent image formed on the surface of the image carrier with toner; and a cleaning device, the cleaning device including:

a first blade contacting the surface of the image carrier; and a second blade separate from the first blade to contact the surface of the image carrier at a position downstream from the first blade in a direction of rotation of the image carrier relative to a transfer position on the surface of the image carrier where the toner image is transferred onto the transfer body, a leading end of the second blade positioned upstream from a trailing end of the second blade relative to the direction of rotation of the image carrier and facing up, and a first edge of the leading end of the second blade contacting the surface of the image carrier at a point on the surface of the image carrier below a second edge of the leading end of the second blade, wherein a face of the leading end of the second blade, provided between the first edge and the second edge, is perpendicular to each of the first and second edges of the second blade.

11. The image forming apparatus according to claim 10, wherein toner used for forming the toner image has a volume average particle diameter (Dv) of from 3 μm to 8 μm, and a ratio (Dv/Dn) of the volume average particle diameter (Dv) to a number average particle diameter (Dn) of from 1.00 to 1.40.

12. The image forming apparatus according to claim 10, wherein toner used for forming the toner image has shape factors SF-1 of from 100 to 180, and SF-2 of from 100 to 180.

13. The image forming apparatus according to claim 10, wherein:

toner used for forming the toner image is substantially spherical;

a relation of $r1 \geqq r2 \geqq r3$ is satisfied, where r1 is a long axis of the toner, r2 is a short axis of the toner, and r3 is a thickness of the toner; and a ratio (r2/r1) of the short axis of the toner to a long axis of the toner is in a range between 0.5 and 1.0, and a ratio (r3/r2) of the thickness of the toner to the short axis of the toner is in a range between 0.7 and 1.0.

14. The cleaning device according to claim 1, further comprising a cartridge casing, the cartridge casing including an upper portion for enclosing the first blade and a lower portion for enclosing the second blade.

15. The cleaning device according to claim 14, further comprising:

a first conveyance screw rotatably provided within a space formed by the first blade and the cartridge case to convey residual toner and a lubricant scraped off by the first blade.

16. The cleaning device according to claim 15, further comprising:

a protective sheet that covers a corner of an opening provided on an upper surface of the cartridge case, from which an upper portion of the image carrier is exposed, to prevent the residual toner and the lubricant scrapped off by the first blade from scattering.

17. The cleaning device according to claim 14, further comprising:

a second conveyance screw rotatably provided within a space formed by the second blade, the cartridge case, and a lubricant applicator to convey residual toner and a lubricant scraped off by the second blade.

18. The cleaning device according to claim 14, further comprising a blade holder for the second blade, the blade holder being attached to the cartridge casing.

19. The cleaning device according to claim 15, further comprising a lubricant applicator to apply a lubricant to the surface of the image carrier, wherein the lubricant applicator is provided in the upper portion of the cartridge casing.

* * * * *